US005081098A

United States Patent [19]

Fukui

[11] Patent Number: 5,081,098

[45] Date of Patent: Jan. 14, 1992

[54] HEAT-SENSITIVE RECORDING MATERIAL

[75] Inventor: Satoshi Fukui, Tokyo, Japan

[73] Assignee: Oji Paper Co., Ltd., Tokyo, Japan

[21] Appl. No.: 524,458

[22] Filed: May 17, 1990

[30] Foreign Application Priority Data

May 26, 1989 [JP] Japan ..... 1-133885

[51] Int. Cl.[5] ..... B41M 5/30

[52] U.S. Cl. ..... 503/209; 503/208; 503/225

[58] Field of Search ..... 503/208, 209, 225; 427/150-152

[56] References Cited

FOREIGN PATENT DOCUMENTS 3534594 4/1986 Fed. Rep. of Germany ..... 503/209
3723282 2/1988 Fed. Rep. of Germany ..... 503/209
2184856 7/1987 United Kingdom ..... 503/209

*Primary Examiner*—Pamela R. Schwartz
*Attorney, Agent, or Firm*—Fish & Richardson

[57] ABSTRACT

A heat-sensitive recording material that utilizes the color forming reaction between at least one basic dye and a developer that is capable of forming a color upon contact with said basic dye is characterized in that the heat-sensitive recording layer of said material contains both dihydroxydiphenyl ether represented by the formula (I):

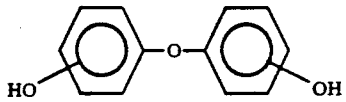

(I)

and a compound represented by the general formula (II):

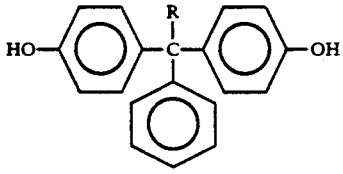

(II)

(where R is H or $C_nH_{2n+1}$, with n being an integer of 1-5). This heat-sensitive recording material has a sufficiently high sensitivity for color formation to kake it suitable for use in a broad range of practical applications and it also exhibits enhanced keeping quality and whiteness.

2 Claims, No Drawings

HEAT-SENSITIVE RECORDING MATERIAL

BACKGROUND OF THE INVENTION

The present invention relates to a heat-sensitive recording material, more particularly, to one that has a high degree of whiteness, that is improved in recording characteristics such as color forming ability and that exhibit good keeping quality.

Heat-sensitive recording materials that rely upon the thermal color forming reaction between at least one colorless or pale-colored basic dye and a developer such as a phenol or an organic acid have been reported in many prior patents including Japanese Patent Publication No. 14039/1970 and some of these materials are extensively used in practical applications such as measuring recorders, computers, terminals of information communications equipment, facsimiles and automatic ticket vendors. The apparatus with which heat-sensitive recording materials can be used are equipped with heat-generating elements such as a thermal head and a thermal pen, which are heated to produce a recording color density. With the recent diversification of uses and sophistication of apparatus, it has become necessary that heat-sensitive recording materials have even higher performance. For instance, at least several minutes were previously required to perform recording on sheets of a size A4 which facsimiles but it is now possible to reduce this period to less than one minute. Under these circumstances, the use of a sensitizer has been proposed as a method of enhancing the sensitivity of heat-sensitive recording materials but in fact, no sensitizer has yet been discovered that attains balance between the various characteristics required of heat-sensitive recording materials such as sensitivity for color formation, image stability and whiteness.

Heat-sensitive recording materials contain the fine particles of a color former and a phenolic compound dispersed in a heat-sensitive recording layer, and either one of the color former and the phenolic compound or both are melted by heating so that they are brought into close contact with each other to form a color. While several phenolic compounds are suitable for this purpose, 2,2-bis(4'-hydroxyphenyl)propane (bisphenol A with m.p. of 156° C.) is extensively used on account of its low price and stable quality (see, for example, U.S. Pat. No. 3,539,375). However, bisphenol A is not quick in thermal response and has not always been capable of meeting the market need for increasing the sensitivity of heat-sensitive recording materials in response to the faster operation or size reduction of thermal recording equipment. In order to compensate for this shortcoming, various sensitizers have been proposed such as waxes (Japanese Patent Public Disclosure No. 19231/1973), phthalate esters (Japanese Patent Public Disclosure Nos. 116690/1982 and 98285/1973), benzyl phenyl ether derivatives (Japanese Patent Public Disclosure No. 155096/1984), benzyl biphenyl (Japanese Patent Public Disclosure No. 82382/1985), naphtholic derivatives (Japanese Patent Public Disclosure No. 87094/1983) and carbonic acid diesters (Japanese Patent Public Disclosure No. 136489/1983). However, the combinations of these sensitizers with bisphenol A have not yet succeeded in providing satisfactory quality in such aspects as whiteness, sensitivity for color formation and fogging. Japanese Patent Public Disclosure No. 144193/1981 proposed the use of benzyl p-hydroxybenzoate or methylbenzyl p-hydroxybenzoate as a developer intended to enhance the sensitivity of heat-sensitive recording sheets. However, this idea has turned out to be unsatisfactory for the purpose of insuring good keeping quality since white spots appeared in the area of color formation during the storage that followed the recording operation.

Thus, none of the heat-sensitive recording materials proposed so far have yet fully satisfied the rigorous requirements of the market for higher quality including good characteristics of color formation and long keeping quality.

The present inventors previously filed Japanese Patent Application No. 4498/1988 on the basis of the finding that a heat-sensitive recording material having high sensitivity and whiteness could be provided by using a dihydroxydiphenyl ether of the formula shown below as a developer:

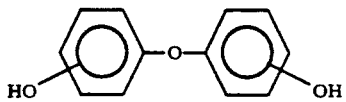

(I)

However, this compound proved to be unsatisfactory in terms of keeping quality. For instance, when the heat-sensitive recording material using this compound was left to stand at 60° C. and 20% R.H. or at 40° C. and 90% R.H. for 24 hours after recording, the image density decreased, sometimes to a level less than 80% of the initial density.

Hence, the present inventors continued their efforts to produce a heat-sensitive recording material that had both high sensitivity and good keeping quality. As a result, they found that not only high sensitivity and whiteness but also good keeping quality could be achieved by using the developer dihydroxydiphenyl ether of the formula (I) in combination with at least one compound selected from the group consisting of 1,1,3-tris(2-methyl-4-hydroxy-5-t-butylphenyl)butane, 1,1,3-tris(2-methyl-4-hydroxy-5-cyclohexylphenyl)butane, 1,3,5-tris(4-t-butyl-3-hydroxy-2,6-dimethylbenzyl-)isocyanuric acid and 1,1-bis(2-methyl-4-hydroxy-5-t-butylphenyl)butane. Based on this finding, the present inventors filed Japanese Patent Application No. 187338/1988.

In order to achieve further improvements in sensitivity and keeping quality, the present inventors continued their research work and found that a heat-sensitive recording material that had good keeping quality and that was more sensitive than the recording material taught in Japanese Patent Application No. 187338/1988 could be obtained by using the developer dihydroxydiphenyl ether (I) in combination with at least one compound selected from the group consisting of 1,1-bis(4-hydroxyphenyl)cyclohexane and a compound represented by the general formula:

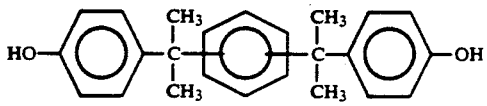

Based on this finding, the present inventors filed Japanese Patent Application No. 20477/1989.

SUMMARY OF THE INVENTION

An object of the present invention is to provide a heat-sensitive recording material that has a higher sensitivity and a better keeping quality than the heat-sensitive recording material described in Japanese Patent Application No. 187338/1988 and that also has a higher degree of whiteness than the heat-sensitive recording material described in Japanese Patent Application No. 20477/1989.

As a result of intensive studies conducted in order to attain this object, the present inventors found that by incorporating the dihydroxydiphenyl ether of the formula (I) in a heat-sensitive recording layer in combination with a compound represented by the general formula (II):

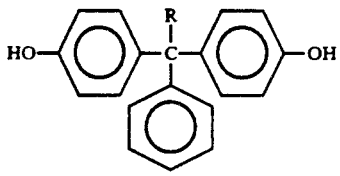

(II)

(where R is H or $C_nH_{2n+1}$, with n being an integer of 1–5), a heat-sensitive recording material could be obtained that had a higher sensitivity and a better keeping quality than the heat-sensitive recording material described in Japanese Patent Application No. 187338/1988 and that also had a higher degree of whiteness than the heat-sensitive recording material described in Japanese Patent Application No. 20477/1989.

DETAILED DESCRIPTION OF THE INVENTION:

Examples of the dihydroxydiphenyl ether represented by the formula (I) include 2,2'-dihydroxydiphenyl ether (m.p. 121° C.), 3,3'-dihydroxydiphenyl ether (m.p. 98° C.) and 4,4'-dihydroxydiphenyl ether (m.p. 166° C.).

Examples of the compound represented by the general formula (II) include 4,4'-(phenylmethylene)bisphenol (m.p. 160° C.; see Japanese Patent Public Disclosure No. 45192/1984) represented by the formula:

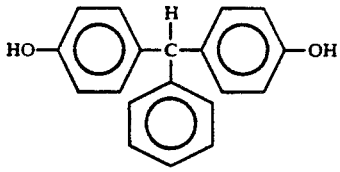

and 4,4'-(1-phenyl ethylidene)bisphenol (m.p. 188° C.; see Japanese Patent Public Disclosure No. 228189/1985) represented by the formula:

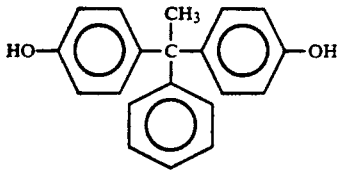

In accordance with the present invention, the dihydroxydiphenyl ether (I) is generally used in an amount of 0.5–3 parts by weight per part by weight of a color forming basic dye, and the compound (II) is generally added in an amount of 0.1–20 parts by weight per part by weight of said developer. Preferably 1–2 parts by weight of the dihydroxydiphenyl ether is used per part by weight of the color forming basic dye, and 0.2–5 parts by weight of the compound (II) is added per part by weight of the dihydroxydiphenyl ether. As a result, the keeping quality of the heat-sensitive recording material is increased markedly, say, a 10–20% improvement is achieved in terms of residual recording density over the case where either the dihydroxydiphenyl ether or the compound (II) is used alone and the result is completely satisfactory from the viewpoint of practical applications. In addition, the sensitivity and whiteness of the recording material are also improved significantly over the case where the two compounds are used individually. This clearly suggests that there is some interaction between the two developers but the exact mechanism by which this interaction improves the keeping quality, sensitivity and whiteness of the heat-sensitive recording material is not completely clear.

The following colorless or pale-colored basic leuco dyes may be used in forming a heat-sensitive recording layer in accordance with the present invention: triarylmethane dyes such as 3,3-bis(p-dimethylaminophenyl)-6-dimethyl aminophthalide, and fluoran dyes such as 3-diethylamino-6-methyl-7-phenylaminofluoran, 3-dibutylamino-6-methyl-7-phenylaminofluoran, 3-(N-cyclohexyl-N-methylamino)-6-methyl-7-phenylaminofluoran, 3-dibutylamino-7-(o-chlorophenylamino)fluoran and 3-(N-ethyl-N-isoamyl)amino-6-methyl-7-phenylaminofluoran.

The dye and the two developers may be used in combination with adjuvants that are commonly employed in heat-sensitive recording materials. For instance, a sensitizer may be used as selected from among parabenzylbiphenyl, dibenzyl terephthalate, phenyl 1-hydroxy-2-naphthoate, dibenzyl oxalate, di-o-chlorobenzyl adipate, 1,2-di(3-methylphenoxy)ethane, di-p-chlorobenzyl oxalate, etc.

The support on which the heat-sensitive color forming layer is formed to make the heat-sensitive recording material of the present invention may be formed of any material such as paper, synthetic fiber paper or synthetic resin film. Paper is generally preferred.

In preparing a coating solution from which the heat-sensitive color forming layer is to be formed, water is used as a dispersion medium in which the basic dye, dihydroxydiphenyl ether and the compound of the general formula (II) are dispersed by means of a pulverizer such as a ball mill, an attritor or a sand grinder. The coating solution contains a binder such as a starch, hydroxyethyl cellulose, methyl cellulose, carboxymethyl cellulose, gelatin, casein, gum arabic, polyvinyl alcohol, styrene/maleic anhydride copolymer salt or a styrene/butadiene copolymer emulsion in an amount of 2–40 wt %, preferably 5–25 wt %, of the total solids content. A variety of adjuvants may be incorporated in the coating solution and illustrative adjuvants include a dispersant (e.g. sodium dioctylsulfosuccinate, sodium dodecylbenzenesulfosuccinate, sodium salt of lauryl alcohol sulfate or a metal salt of aliphatic acid), a defoamer, a fluorescent dye and a coloring dye. In order to further increase the whiteness of the heat-sensitive recording layer, an inorganic pigment such as kaolin, clay, talc, calcium carbonate, calcined clay, titanium oxide, diatomaceous earth or fine particulate anhydrous silica may be added. Also usable are waxes such as dispersions or emulsions of stearic acid, polyethylene, carnauba wax, paraffin wax, calcium stearate, zinc stearate and ester waxes.

The heat-sensitive recording layer may be formed by any method in the heat-sensitive recording material of the present invention. If a heat-sensitive paint is to be coated onto the support, an appropriate applicator such as an air-knife coater or a blade coater may be employed. The heat-sensitive color forming layer is generally formed in such an amount that the dry weight is within the range of 2–12 g/m$^2$, preferably 3–8 g/m$^2$. It should be understood that various known modifications such as the provision of an undercoat layer may be adopted in the heat-sensitive recording material of the present invention.

The following examples are provided for the purpose of further illustrating the present invention but are in no way to be taken as limiting. In the following examples and comparative examples, all "parts" and "%" are on a weight basis.

EXAMPLE 1

(1) Preparation of Solution A

| | |
|---|---|
| 3-(N-cyclohexyl-N-methylamino)-6-methyl-7-phenylaminofluoran | 40 parts |
| Polyvinyl alcohol (10% aq. sol.) | 20 parts |
| Water | 20 parts |

A composition consisting of these ingredients was pulverized with a sand grinder to an average particle size of 1 μm.

(2) Preparation of Solution B

| | |
|---|---|
| 4,4'-dihydroxydiphenyl ether | 40 parts |
| Polyvinyl alcohol (10 aq. sol.) | 20 parts |
| Water | 20 parts |

A composition consisting of these ingredients was pulverized with a sand grinder to an average particle size of 1.5 μm.

(3) Preparation of Solution C

| | |
|---|---|
| Parabenzylbiphenyl | 40 parts |
| Polyvinyl alcohol (10% aq. sol.) | 20 parts |
| Water | 20 parts |

A composition consisting of these ingredients was pulverized with a sand grinder to an average particle size of 1.5 μm.

(4) Preparation of Solution D

| | |
|---|---|
| 4,4'-(1-phenyl ethylidene)bisphenol | 40 parts |
| Polyvinyl alcohol (10% aq. sol.) | 20 parts |
| Water | 20 parts |

A composition consisting of these ingredients was pulverized with a sand grinder to an average particle size of 1.5 μm.

Seventy-five parts of 10% aqueous polyvinyl alcohol was added to a mixture of Solution A (10 parts), Solution B (20 parts), Solution C (20 parts), Solution D (10 parts), a dispersion of 50% calcium carbonate (30 parts) and a dispersion of 30% zinc stearate (8 parts) under stirring to form a coating solution. This solution was applied onto a sheet of raw paper (50 g/m$^2$) to give a deposit having a dry weight of 7 g/m$^2$. By subsequent drying, a sheet of heat-sensitive recording paper was obtained.

EXAMPLE 2

A sheet of heat-sensitive recording paper was produced by repeating the procedure of Example 1 except that the 4,4'-(1-phenyl ethylidene)bisphenol in solution D was replaced by an equal volume of 4,4'-(phenylmethylene)bisphenol.

COMPARATIVE EXAMPLE 1

A comparative sample of heat-sensitive recording paper was produced by repeating the procedure of Example 1 except that instead of using Solution B, the amount of Solution D was increased to 30 parts.

COMPARATIVE EXAMPLE 2

Another comparative sample of heat-sensitive recording paper was produced by repeating the procedure of Example 1 except that instead of using Solution D, the amount of Solution B was increased to 30 parts.

COMPARATIVE EXAMPLE 3

Still another comparative sample of heat-sensitive recording paper was produced by repeating the procedure of Example 2 except that instead of using Solution B, the amount of Solution D was increased to 30 parts.

The five samples of heat-sensitive recording paper were supercalendered before printing was done with a Model UF-60 of Matsushita Graphic Communication Systems, Inc. The recording density on each sample was measured with a densitometer Model RD-100R of Macbeth Corporation. The whiteness of each sample was measured with a Hunter whiteness meter.

The prints were subjected to a storage test and the percent residue of the recording density was calculated by the following formula:

$$\frac{\text{Recording density after storage test}}{\text{Initial density}} \times 100(\%).$$

The storage test was performed under two different conditions: (1) exposure to 60° C.×20% R.H. for 24 hours; and (2) exposure to 40° C.×90% R.H. for 24 hours.

The results of the measurements and test are shown in the following table.

TABLE 1

| | Initial density | After storage test 60° C. × 20% R.H. density | 60° C. × 20% R.H. percent residue | 40° C. × 90% R.H. density | 40° C. × 90% R.H. percent residue | Whiteness |
|---|---|---|---|---|---|---|
| Ex. 1 | 1.44 | 1.43 | 99 | 1.42 | 99 | 84.2 |
| 2 | 1.45 | 1.42 | 99 | 1.43 | 99 | 84.1 |
| Comp. Ex. 1 | 1.20 | 1.01 | 84 | 0.98 | 82 | 83.0 |
| 2 | 1.33 | 1.05 | 79 | 1.03 | 77 | 82.5 |
| 3 | 1.22 | 1.02 | 84 | 0.99 | 81 | 83.2 |

As is clear from the above table, incorporating 4,4'-dihydroxydiphenyl ether incombination with the compound of the formula (II) provided a synergistic effect in that the heat-sensitive recording materials of the present invention were much better in recording density, keeping quality and whiteness than when the respective compounds were used independently as in the comparative samples.

The present invention therefore provides a heat-sensitive recording material that has a sufficiently high sensitivity for color formation to make it suitable for use in a broad range of practical applications and which also exhibits enhanced keeping quality and whiteness.

What is claimed is:

1. In a heat-sensitive recording material that utilizes the color forming reaction between at least one basic dye and a developer that is capable of forming a color upon contact with said basic dye, the improvement wherein the heat-sensitive recording layer of said material contains both dihydroxydiphenyl ether represented by the formula (I):

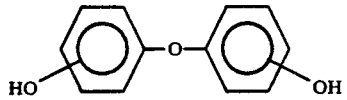

(I)

and a compound represented by the general formula (II):

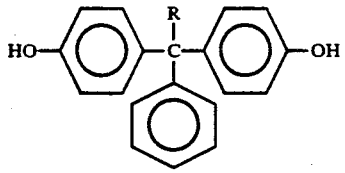

(II)

where R is H or $C_nH_{2n+1}$, with n being an integer of 1–5.

2. A heat-sensitive recording material according to claim 1 wherein dihydroxydiphenyl ether is in an amount of 0.5–3 parts by weight per part by weight of basic dye and a compound of the formula (II) is in an amount of 0.1–20 parts by weight per part by weight of dihydroxydiphenyl ether.

* * * * *